US006338215B1

(12) United States Patent
Vincent

(10) Patent No.: US 6,338,215 B1
(45) Date of Patent: Jan. 15, 2002

(54) PARALLEL PLANE PICTURE FRAME ARRAY

(75) Inventor: Thomas Vincent, San Rafael, CA (US)

(73) Assignee: Umbra, Inc., Buffalo, NY (US)

( * ) Notice: Subject to any disclaimer, the term of this patent is extended or adjusted under 35 U.S.C. 154(b) by 0 days.

(21) Appl. No.: 09/545,380

(22) Filed: Apr. 7, 2000

(51) Int. Cl.[7] ..... A47G 1/06
(52) U.S. Cl. ..... 40/730; 40/729
(58) Field of Search ..... 40/152, 605, 729, 40/730, 731, 733; D6/301, 302

(56) References Cited

U.S. PATENT DOCUMENTS

| | | | | | |
|---|---|---|---|---|---|
| 353,326 | A | * | 11/1886 | Petermann | 40/733 X |
| 3,125,385 | A | * | 3/1964 | Friedman | 312/111 X |
| 3,426,913 | A | | 2/1969 | Abatiell, Jr. | |
| 3,529,374 | A | | 9/1970 | Spertus | |
| 3,722,122 | A | | 3/1973 | Sesto | |
| 3,822,487 | A | * | 7/1974 | Koch | 40/620 X |
| 4,017,989 | A | | 4/1977 | Murray | |
| 4,115,938 | A | | 9/1978 | Belmuth et al. | |
| 4,608,770 | A | | 9/1986 | Gray | |
| 4,706,397 | A | | 11/1987 | Hesener | |
| 4,827,639 | A | | 5/1989 | Wang | |
| 5,267,403 | A | | 12/1993 | Hesner | |
| 5,323,552 | A | | 6/1994 | Fritz | |
| 5,492,399 | A | * | 2/1996 | Tillack | 312/111 |
| 5,544,438 | A | | 8/1996 | Fazekas | |
| 5,581,922 | A | | 12/1996 | Heimann | |
| 6,112,445 | A | * | 9/2000 | Feeney | 40/747 |

FOREIGN PATENT DOCUMENTS

| | | |
|---|---|---|
| GB | 1185011 | 3/1970 |

* cited by examiner

*Primary Examiner*—Brian K. Green
(74) *Attorney, Agent, or Firm*—Saidman DesignLaw Group

(57) ABSTRACT

A 3-dimensional array of picture frames is arranged in a plurality of parallel planes. The picture frames are interconnected by perpendicularly extending pegs frictionally received in blind bores in the front of the rearward frame and in the back of the forward frame. Replaceable decorative sleeves surround the pegs.

8 Claims, 3 Drawing Sheets

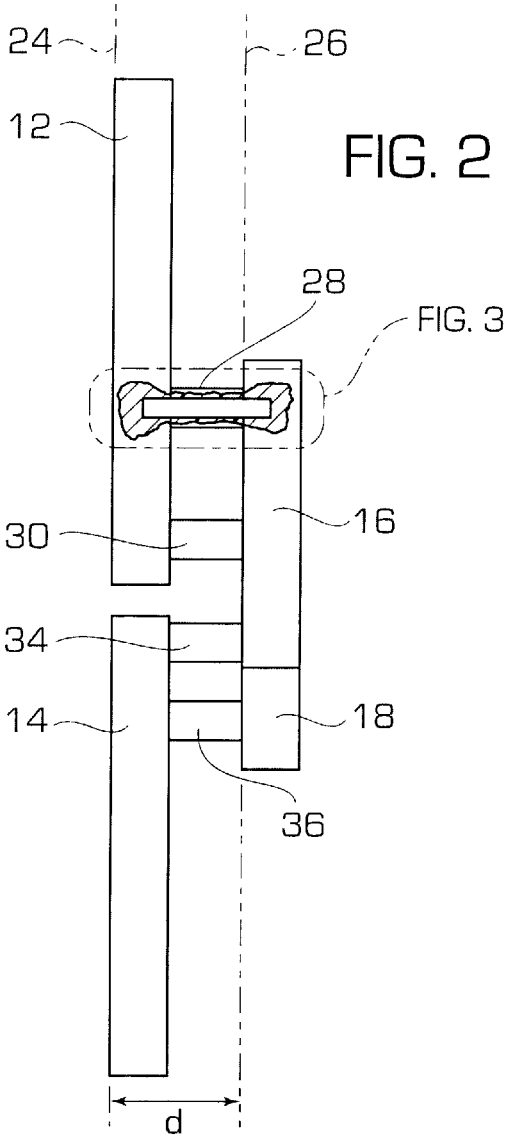
FIG. 2
FIG. 3
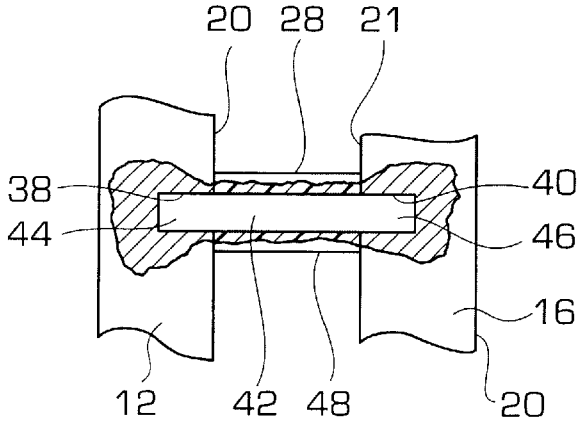

PARALLEL PLANE PICTURE FRAME ARRAY

BACKGROUND OF THE INVENTION

1. Field of The Invention

This invention relates to improvements in displaying an array of picture frames, specifically a preselected arrangement of picture frames interconnected such that a 3-dimensional effect is produced.

2. Description of Related Art

Displaying an array of picture frames, such as by hanging them on a wall, is as old as picture frames themselves. Usually they are hung individually. This results in arrangements which are often less attractive than was desired or envisioned, due to the failure to accurately orient the picture frames relative to each other. Misalignments frequently occur and are difficult to correct. More importantly, the arrangements are virtually limited to 2-dimensional, essentially flat, arrays. It would be desirable to reap the benefits of an interior decorator's talent while adding a 3-dimensional flair to the displaying of picture frames. Both can be achieved by rigidly interconnecting a plurality of picture frames in a 3-dimensional array.

Patents directed toward connecting picture frames to form a 3-dimensional array are surprisingly few. The following U.S patents are, however, representative of the prior art.

U.S. Pat. No. 3,722,122, issued to Sesto, shows connecting a plurality of picture frames together to form a 3-dimensional array. Sesto employs connectors shaped as solid pegs integral with C-shaped clips. The pegs are designed for insertion into channels in the back border of forward oriented picture frames, while the C-shaped clips are designed for attachment to the edges of rearwardly oriented picture frames. The combination has its disadvantages, e.g., the frames and clips must be specially molded to interfit as described, and the clips are always visible.

U.S. Pat. No. 4,827,639, issued to Wang, shows an S-shaped clip designed such that the edges of two picture frames may be inserted into the bights of the "S", thereby holding the frames in parallel, spaced planes. Apparently, the clip and the bottom edges of the frames are intended to support the array on a flat surface. While effective in holding the two frames together, the clip is manifestly unsightly.

Spacers used to interconnect pictorial displays are also known. For example, U.S. Pat. No. 3,426,913 issued to Abatiell shows spacer locks for interconnecting display panels. The spacer locks are made of steel tubing having a bushing and a pair of enlarged washers brazed thereto. The assembly is then chromed for a decorative appearance. The spacer locks are disclosed as being used in vertical orientation such that the shoulders provided by the washers can support two displays one above the other; no 3-dimensional aspect is taught. Also, the spacer locks are expensive to manufacture and uniform in appearance.

In each of the above-discussed patents, the structures involved are complicated, expensive, and/or unsightly.

OBJECTS AND SUMMARY OF THE INVENTION

The present invention overcomes the difficulties described above by interconnecting a plurality of picture frames by rods extending between picture frames in two parallel planes.

It is an object of the invention to provide an array of picture frames connected in simple, inexpensive, and aesthetically pleasing combinations.

It is a further object of the invention to provide an array of picture frames which are the rigidly fixed together in an arrangement designed by professional decorators.

It is a further object of the invention to provide a manner of interconnecting a plurality of picture frames such that they appear to be floating in space when supported on a wall or a horizontal surface.

It is a further object of the invention to provide an array of picture frames in which the picture frames are arranged in two parallel planes.

It is a further object of the invention to provide an array of picture frames in which each of the picture frames in a forward plane overlap at least two picture frames in a rearward plane.

It is a further object of the invention to provide an array of picture frames arranged in a forward plane and a rearward plane, in which each of the picture frames in the forward plane are supported only by the picture frames in the rearward plane.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which:

FIG. 2 is a side view of the embodiment of FIG. 1;

FIG. 3 is an enlarged, fragmentary, partially broken away, side view of a preferred mode of interconnecting the frames of the embodiment of FIG. 1.

DETAILED DESCRIPTION OF THE PREFERRED EMBODIMENT

Figure 1:
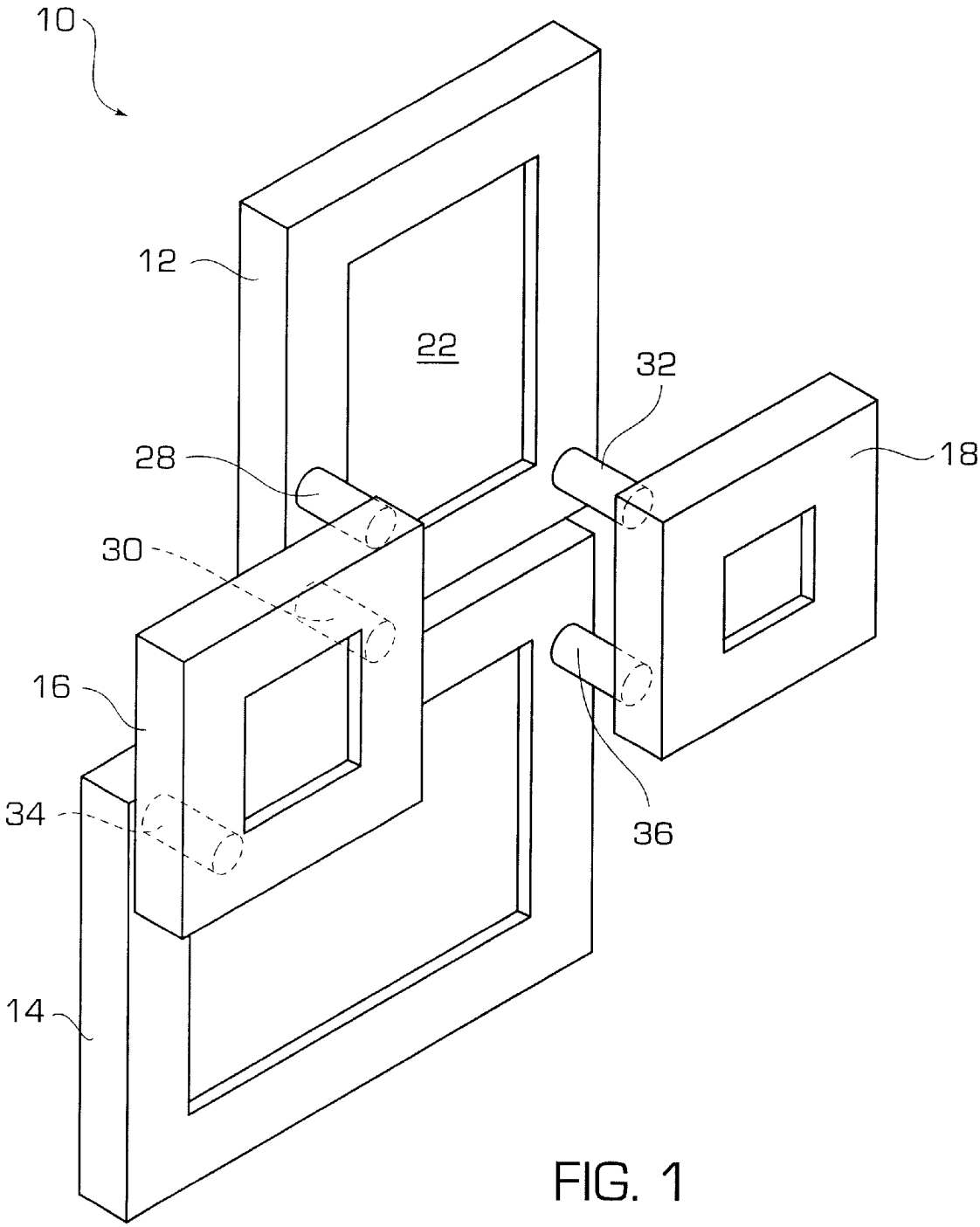
FIG. 1 is a perspective view which illustrates a preferred embodiment of the present invention.

Referring to FIG. 1, an array 10 of picture frames is shown. Four picture frames 12, 14, 16, and 18 are included in the disclosed embodiment, although any number can be chosen, aesthetics permitting. Each picture frame, such as frame 12, includes a space 22 enclosed by frame 12 for a photograph, print, or other pictorial representation (not shown).

In the preferred embodiment, picture frames 12–18 are arranged in two parallel planes (FIG. 2), a rearward plane 24 containing picture frames 12 and 14 and a forward plane 26 containing picture frames 16 and 18. It is possible that frames 12–18 can be arranged in three or more planes, if desired, as will be discussed in greater detail below. The protrusion of frames 16 and 18 in front of frames 12 and 14 provide a 3-dimensional effect when hung on a wall by a hook (not shown) or when supported on a planar surface by a conventional flap (not shown) hinged to the back of array 10. The illusion is heightened by the manner in which picture frames 12–18 are interconnected.

In this preferred embodiment, the picture frames 12 and 14 in rearward plane 24 are connected exclusively to the picture frames 16 and 18 in forward plane 26. There are no connectors directly interconnecting picture frames which reside solely in either single plane. That is, in this preferred embodiment, there are no connectors directly between frames 12 and 14, or between frames 16 and 18; this adds appreciably to the unique aesthetic effect produced by the present invention.

In the embodiment shown, connectors 28 and 30 extend outwardly from the front of frame 12 to the rear of frame 16, and connector 32 similarly interconnects the front of frame 12 to the rear of frame 18. Picture frames 16 and 18 are connected to picture frame 14 by connectors 34 and 36, respectively. The frames of array 10 are connected sufficiently rigidly by connectors 28–36 such that the forward picture frames 16 and 18 are supported entirely by the rearward picture frames 12 and 14.

Figure 4:
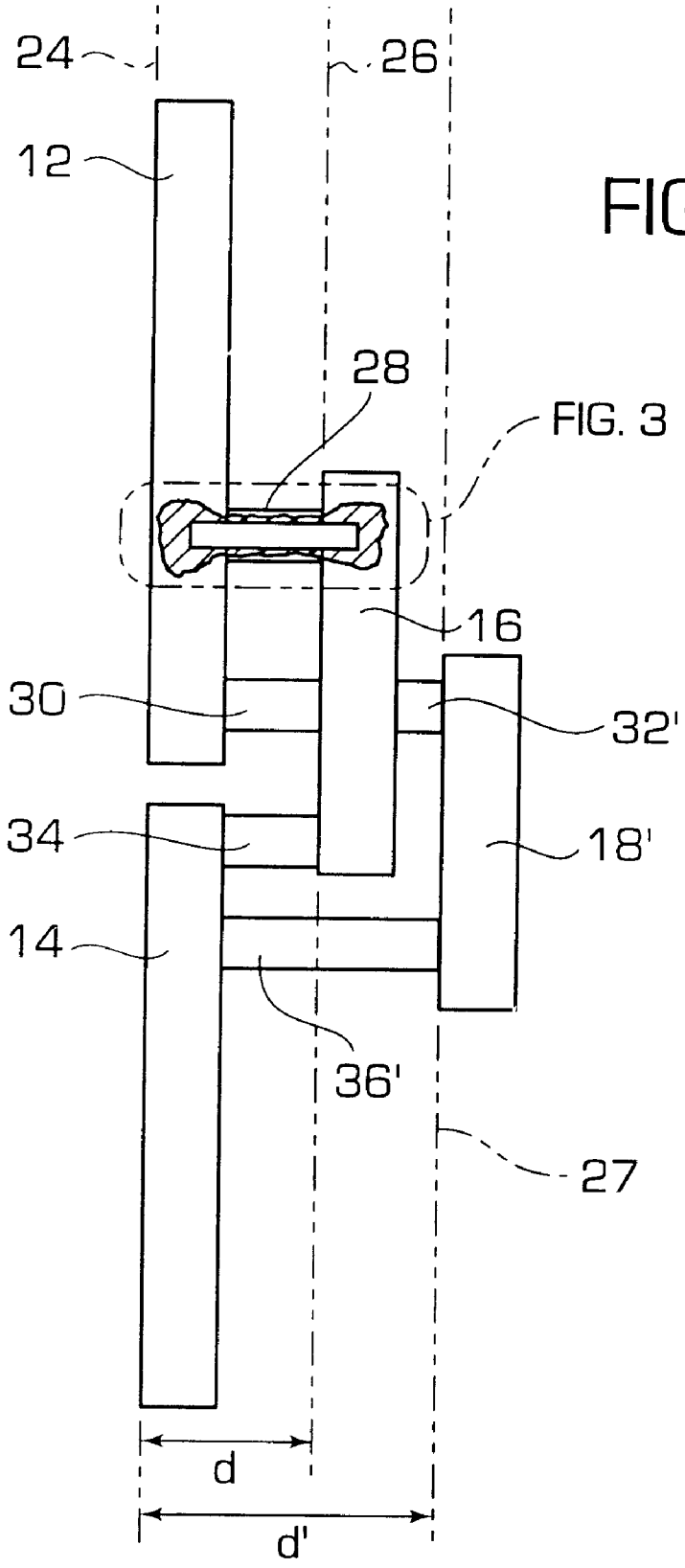
FIG. 4 is a side view of an alternative embodiment of the present invention.

Alternatively, connectors 32 and 36 may be selected to be a different length (i.e., longer or shorter) than connectors 28, 30 and 34. An example of this alternative embodiment is shown in FIG. 4. In this embodiment, connectors 32' and 36' are longer than connectors 28, 30 and 34, and picture frame 18' is positioned in a third plane 27 which is in front of and parallel to the plane formed by picture frame 16, and in front of and parallel to the plane formed by picture frames 12 and 14. As can be seen, planes 26 and 27 of picture frames 12 and 18' are spaced from each other a preselected distance d' by connectors 32' and 36', which is greater than distance d. In such an embodiment, connectors 32' and 36' must be the same length. Such length is different than the length of connectors 28, 30 and 34, which similarly must all be the same length as each other. Again, in the preferred embodiment shown in FIGS. 1 and 2, all connectors are of the same length, such that the picture frames reside in two parallel, spaced planes. It should be clear from this description that as additional picture frames are added to a given array, a plurality of different planes may be formed by the frames depending on the selection of the length of the connectors.

It will be noted that in the preferred embodiment shown in FIGS. 1 and 2, each picture frame includes at least two connectors connected to at least two different picture frames. The number and placement of connectors for each picture frame are chosen to ensure that none of the picture frames in array 10 will be capable of relative rotational movement which might torque them out of their desired arrangement. Because of the manner of the interconnections between picture frames, the entire array can be supported by a single, well placed hook or flap, usually hidden behind one of the picture frames in array 10. Thus, when viewed from the front, the forward picture frames 16 and 18 appear to be floating in space, creating a most unusual and distinctive appearance.

FIG. 2 shows a side view of array 10 with connector 28 partially broken away to illustrate the preferred structure thereof. As can be seen, the two planes 24 and 26 of picture frames 12–18 are spaced from each other a preselected distance "d" by connectors 28–36.

FIG. 3 is an enlargement of the partially broken away view of connector 28 enclosed by the broken line in FIG. 2. As seen in FIG. 3, a blind bore 38 is formed in the front of frame 12, and a similar blind bore 40 is formed in the back of frame 16. Connector 28 preferably comprises a cylindrical peg 42 whose opposite ends 44 and 46 are frictionally inserted within bores 38 and 40, respectively. A preferably decorative (e.g., metallic chrome or finished wood) tubular sheath 48 loosely surrounds peg 42 and abuts the forward surface 20 of picture frame 12 and the rear surface 21 of picture frame 16. Sheath 48 is easily removed and replaced should the desire to change the appearance of array 10 arises. Sheath 48 also allows the use of inexpensive wooden, plastic, or metal pegs 42 while providing a convenient method of harmonizing the colors and textures of frames 12–18 with connectors 28–36. All of connectors 28–36 preferably comprise the peg/sheath combination illustrated for connector 28.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It can be seen from the above that an invention has been disclosed which fulfills all the objects of the invention. It is to be understood, however, that the disclosure is by way of illustration only and that the scope of the invention is to be limited solely by the following claims:

I claim as my invention:

1. An array of picture frames, comprising:

a plurality of picture frames, including a first set of picture frames located in a first plane and a second set of picture frames located in a second plane that is parallel to and spaced from said first plane a first distance, each of said picture frames including four frame members interconnected in a rectangular configuration, each of said frame members having a substantially planar front surface and a substantially planar rear surface, said front and rear surfaces being substantially parallel to but spaced from each other; and a first set of substantially cylindrical connectors that are affixed to and extend between said front surfaces of said first set of picture frames and said rear surfaces of said second set of picture frames, each of said first set of connectors being perpendicular to said first and second planes and substantially exposed to view as part of the visual design of said array of picture frames.

2. The array of picture frames according to claim 1, wherein each of said first set of connectors are of substantially the same length, which generally defines the distance between said first and second planes.

3. The array of picture frames according to claim 1, wherein said plurality of picture frames further comprises a third set of picture frames located in a third plane that is parallel to and spaced from both said first and second planes.

4. The array of picture frames according to claim 3, further comprising a second set of substantially cylindrical connectors that are perpendicular to said third plane and are affixed to and extend between said front or rear surfaces of said third set of picture frames and said rear or front surfaces, respectively, of either said first or second set of picture frames.

5. The array of picture frames according to claim 4, wherein said second set of connectors are a different length than said first set of connectors.

6. The array of picture frames according to claim 1, wherein said first distance is greater than the thickness of any one of said picture frames as measured from said front surface to said rear surface thereof.

7. The array of picture frames according to claim 1, wherein each of said connectors of said first set of substantially cylindrical connectors is surrounded by a tubular sheath.

8. The array of picture frames according to claim 7, wherein said sheath is formed of plastic.

* * * * *